US011381036B2

(12) United States Patent
Ho et al.

(10) Patent No.: US 11,381,036 B2
(45) Date of Patent: Jul. 5, 2022

(54) POWER PLUGS WITH LOCK RINGS

(71) Applicants: Hewlett-Packard Development Company, L.P., Spring, TX (US); Chin-Chang Ho, Taipei (TW); Jen-Hsun Hsieh, Taipei (TW); Po Cheng Liao, Taipei (TW); Chen Ee Eunice Goh, Singapore (SG)

(72) Inventors: Chin-Chang Ho, Taipei (TW); Jen-Hsun Hsieh, Taipei (TW); Po Cheng Liao, Taipei (TW); Chen Ee Eunice Goh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,178

(22) PCT Filed: Aug. 30, 2018

(86) PCT No.: PCT/CN2018/103166
§ 371 (c)(1),
(2) Date: Oct. 20, 2020

(87) PCT Pub. No.: WO2020/042059
PCT Pub. Date: Mar. 5, 2020

(65) Prior Publication Data

US 2021/0384673 A1 Dec. 9, 2021

(51) Int. Cl.
*H01R 13/639* (2006.01)
*H01R 13/502* (2006.01)
(Continued)

(52) U.S. Cl.
CPC ..... *H01R 13/639* (2013.01); *H01R 13/502* (2013.01); *H01R 13/625* (2013.01); *H01R 24/38* (2013.01)

(58) Field of Classification Search
CPC .. H01R 13/639; H01R 13/502; H01R 13/625; H01R 24/38; H01R 13/6277
See application file for complete search history.

(56) References Cited

U.S. PATENT DOCUMENTS 3,352,576 A * 11/1967 Thorne-Thomsen ..... F16L 37/088 285/148.2
5,938,465 A * 8/1999 Fox, Sr. ..... H01R 13/627 439/350

(Continued)

FOREIGN PATENT DOCUMENTS

CN 201556781 8/2010
CN 201838810 5/2011

(Continued)

OTHER PUBLICATIONS

Locking Push-On RF Connector for Harsh Environments, Mar. 15, 2018 Microwave Journal.

*Primary Examiner* — Tho D Ta
(74) *Attorney, Agent, or Firm* — HP Inc. Patent Department

(57) ABSTRACT

In an example, a power plug may include a connector to engage with a power receptacle of an electronic device, and a removable lock ring disposed around the connector. The lock ring may include a lock tab disposed on the lock ring and extending in a direction away from a longitudinal axis of the power plug. The lock tab may insert into a lock notch of the power receptacle.

12 Claims, 5 Drawing Sheets

(51) Int. Cl.
*H01R 13/625* (2006.01)
*H01R 24/38* (2011.01)

(56) References Cited

U.S. PATENT DOCUMENTS

| | | | | |
|---|---|---|---|---|
| 6,196,865 | B1 | 3/2001 | Ruffel et al. | |
| 6,811,422 | B1 * | 11/2004 | Muller | H01R 13/625 439/255 |
| 6,971,255 | B2 | 12/2005 | Bhogal et al. | |
| 7,070,458 | B2 * | 7/2006 | Axenbock | H01R 13/2421 439/272 |
| 9,595,788 | B1 | 3/2017 | Luksic et al. | |
| 9,722,355 | B1 | 8/2017 | Dong et al. | |
| 2013/0316557 | A1 | 11/2013 | Kao et al. | |
| 2015/0180167 | A1 * | 6/2015 | Haas | H01R 13/64 439/311 |

FOREIGN PATENT DOCUMENTS

| | | | | |
|---|---|---|---|---|
| CN | 103618170 | | 3/2014 | |
| CN | 104009330 | | 8/2014 | |
| CN | 106602357 | | 4/2017 | |
| CN | 106785690 | | 5/2017 | |
| CN | 108134257 | A | 6/2018 | |
| DE | 4301506 | A1 * | 7/1994 | H01R 13/625 |
| GB | 2438561 | A | 11/2007 | |
| JP | 2000181578 | | 6/2000 | |
| JP | 2005209561 | A | 8/2005 | |
| WO | WO2014155274 | A1 | 10/2014 | |

* cited by examiner

POWER PLUGS WITH LOCK RINGS

BACKGROUND

Electronic devices may engage with cables and connectors for a variety of purposes. Some cables and connectors may provide signals such as data or other communication signals, while others may provide power to the electronic device. Such power cables may engage an electronic device with a power source and may include a power plug to engage with a power receptacle of the electronic device. Some power cables may engage an electronic device with a wall outlet or other power source.

DETAILED DESCRIPTION

Figure 1A:
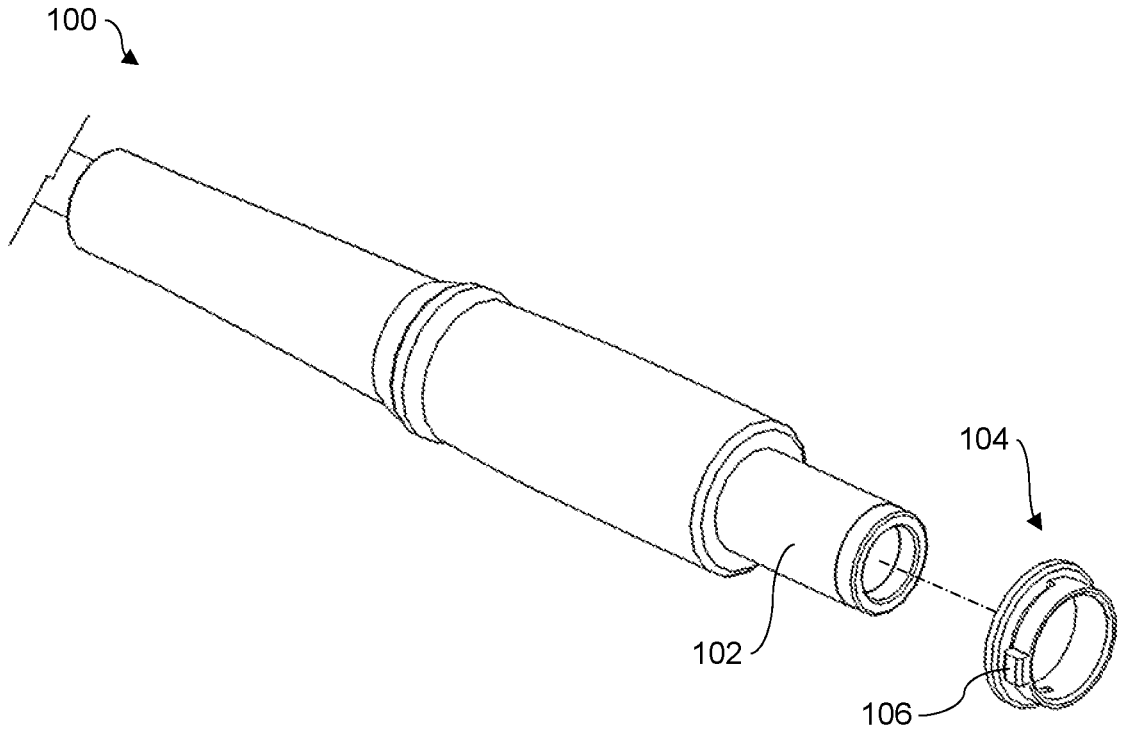
FIG. 1A is a perspective exploded view of an example power plug with a lock ring.

Electronic devices may engage with cables and connectors for a variety of purposes. Some cables and connectors may provide signals such as data or other communication signals, while others may provide power to the electronic device. Such power cables may engage an electronic device with a power source, for example, from a wall outlet, portable power supply, an uninterruptable power supply (UPS), or other power sources. In some situations, the power cable may engage with an alternating current (AC) power source and may include a power adapter to convert the AC power signal into a direct current (DC) power signal to provide the DC power signal to an electronic device.

Power cables may include a power plug having a connector designed to mechanically and electrically engage with a power receptacle of an electronic device. In some situations, the power plug and/or connector may operably engage with a power receptacle by being pushed directly into the power receptacle. The power plug and/or connector may be retained in the power receptacle by a slip fit, or sometimes by an interference or friction fit. However, such slip fit or friction fit of the power plug and/or connector may not be sufficiently robust enough to prevent the power plug from disengaging from the receptacle upon an accidental movement or tension on the power plug, for example, by a user accidentally kicking, tripping over, or tugging on the power plug without realizing it. In such cases, inadvertent disengagement of the power plug with the receptacle may result in potential negative effects on the performance of, or the shutting down completely of, the electronic device.

In some situations, supplemental plug retention devices may be employed to make it more difficult to accidentally unplug or disengage a power plug from an electronic device. Such supplemental retention devices may include adding an additional O-ring or other friction-inducing component into the power receptacle to help retain the power plug, adding a cable hook to the exterior of the electronic device, or adding a cam or ratchet device to the connector of the power plug to hold the power plug in operable engagement with the receptacle of the electronic device. Such existing techniques may require extensive additional design, manufacturing and/or assembly steps of the electronic device, or the inclusion of specialty components, thereby increasing cost and complexity, and/or restricting the use of the power plug to a specific electronic device or line of electronic devices.

Implementations of the present disclosure provide a way to prevent or minimize accidental unplugging or disengagement of a power plug from an electronic device, while avoiding significant extra development cost or complexity, and also while maintaining the ability of the power plug to be used with many different devices. Implementations of the present disclosure provide power plugs with lock rings, wherein the lock ring may be a supplemental retention device that may be employed with existing universal power plugs.

Referring now to FIG. 1A, an exploded perspective view of an example power plug 100 is illustrated. Power plug 100 may include a connector 102 which may be able to engage or interface with a power receptacle of an electronic device. In some situations, the power plug 100 may be a universal power plug or may include a universal connector that may be designed to be used with many different types of electronic devices, or power receptacles thereof. The power plug 100 may be used to provide power to an electronic device. In other implementations, the power plug 100 may not be a power plug, but another type of communication plug, cable, and/or connector to provide data or other communication signals to the electronic device. In some implementations, the power plug 100 may be a part of a power adapter which may connect to an AC power source, convert the AC power signal to a DC power signal, and then provide such DC power signal, by way of the power plug 100, to an electronic device or the power receptacle thereof.

Figure 1B:
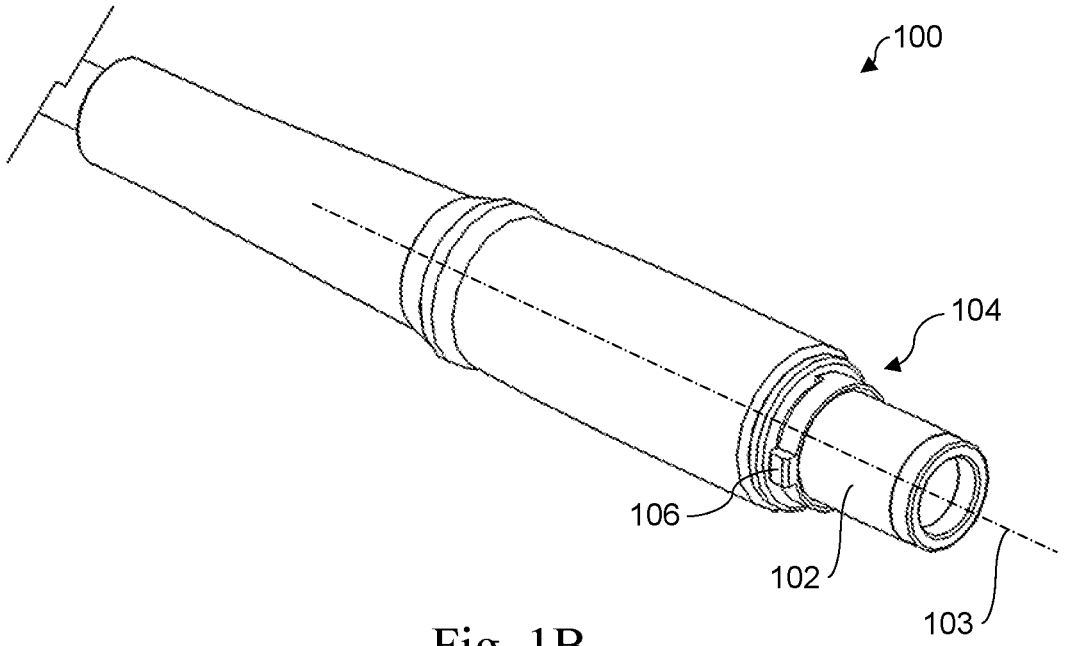
FIG. 1B is a perspective view of the example power plug of FIG. 1A with a lock ring.

The power plug 100, and/or the connector 102 thereof may be used in conjunction with a removable lock ring 104. When power plug 100 is used in conjunction with the lock ring 104, in some situations the lock ring 104 may be considered as being a part of the power plug 100. The lock ring 104 may be considered removable in the sense that the power plug 100 may still be able to operably engage with an electronic device so as to provide power to the electronic device without the use of the lock ring 104, or with the use of the lock ring 104, and that the lock ring 104, once installed on to the power plug 100, may be able to be removed again. Referring additionally to FIG. 1B, another perspective view of example power plug 100 is illustrated wherein the lock ring 104 is installed on to the power plug 100. When employed with the power plug 100, the lock ring 104 may be slid on to the connector 102 such that the lock ring 104 is disposed around the connector 102, as illustrated. Further, the lock ring 104 may include a lock tab 106, which may be a protrusion that, when the lock ring 104 is installed, may extend away from the connector 102 and in a direction away from a longitudinal axis of the power plug, for example, axis 103. In other words, the lock tab 106 may extend radially from the connector 102. The lock tab 106 may be sized and shaped sufficiently to insert into a lock notch of the power receptacle. In some implementations, the lock ring 104 may be slid or pressed onto the connector 102 with such tolerances, tightness, or friction so as to effectively fix the lock tab 106 relative to the connector 102. In other implementations, e.g., described below with regard to FIGS. 2A-2C, the lock ring 104 may be loosely slid onto the connector 102 and then may clamp around the outer periphery or circumference of the connector 102 such that the lock tab 106 is effectively fixed relative to the connector 102. In this context, effectively fixed may refer to the ability of the lock ring 104 to hold the lock tab 106 in position on the connector 102, yet with enough force or loosening of the lock ring 104, may still be able to be removed from the connector 102, and thus the power plug 100, if desired.

Figure 2A:
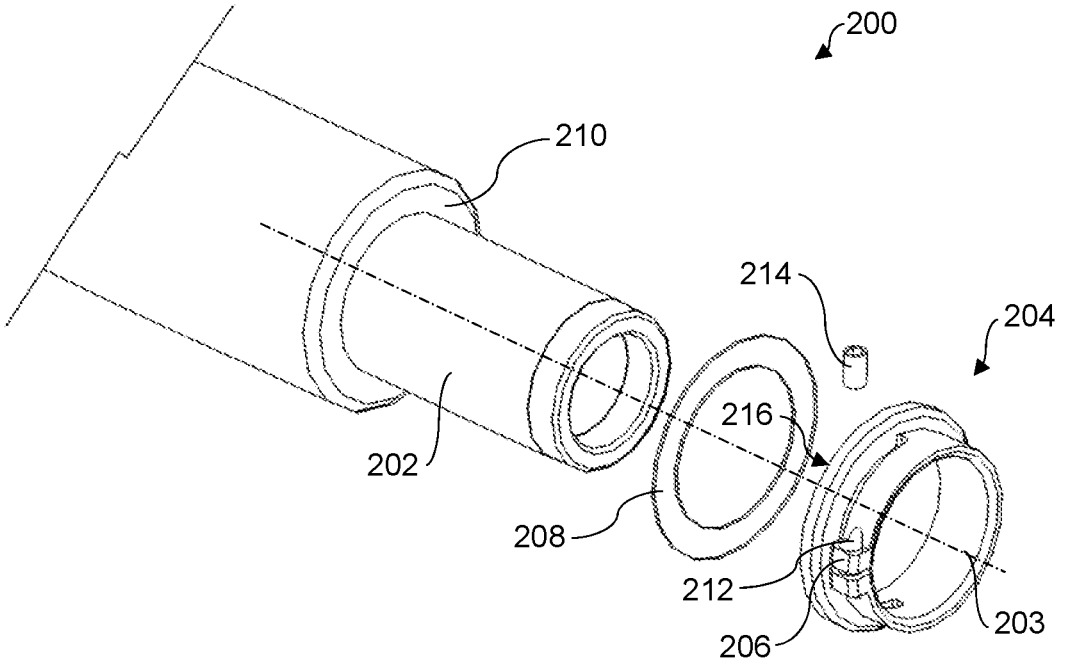
FIG. 2A is a perspective exploded view of another example power plug with a lock ring.

Referring now to FIG. 2A, an exploded perspective view of another example power plug 200 is illustrated. Example power plug 200 may be similar to example power plug 100, described above. Further, the similarly-named elements of example power plug 200 may be similar in function and/or structure to the respective elements of example power plug 100, as they are described above. Power plug 200 may include a removable lock ring 204, which may be slid and/or installed onto a connector 202 of the power plug 200, e.g., along longitudinal axis 203. The lock ring 204 may include a lock tab 206 extending in a direction away from longitudinal axis 203, which may include a fastener opening 212 to receive a fastener 214. When the lock ring is slid or installed onto the connector 202, the fastener 214 may be inserted into and/or tightened within the fastener opening 212 to clamp the lock ring around the outer periphery of the connector 202. Thus, in order to remove the lock ring 204 once installed, the fastener 214 may be loosened and/or removed from the fastener opening 212, and the lock ring 204 may be slid off of the connector 202. The fastener 214 may be a screw, bolt, pin, or other suitable mechanical fastener, and the fastener opening 212 may be a complementary receptacle, aperture, slot, or other type of opening having a sufficient size, structure, and features, e.g., threads, to receive the fastener 214.

In some situations, the fastener 214 alone may be sufficient to install and effectively fix the lock ring 204 onto the connector 202, but in other implementations, the lock ring 204 may also include an adhesive, or an adhesive film 208 to fix the lock ring 204 onto the connector 202. In yet further implementations, the lock ring 204 may utilize the adhesive 208 alone, and omit the fastener 214, to achieve the desired installation security. In some implementations, the lock ring 204, when installed, may abut against a shoulder 210 of the power plug 200, adjacent to the connector 202. In other implementations wherein adhesive 208 is employed, either alone or in conjunction with the fastener 214, the adhesive 208 may be used to fix or adhere the lock ring 204 to the shoulder 210 of the power plug 200. In other words, the adhesive 208 may be applied between the shoulder 210 and a back side 216 of the lock ring 204.

Figure 2B:
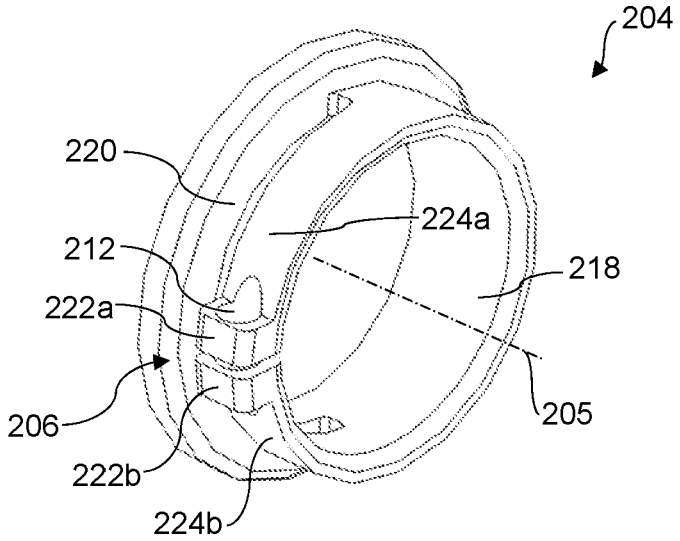
FIG. 2B is a perspective view of the example lock ring of the example power plug of FIG. 2A.
Figure 2C:
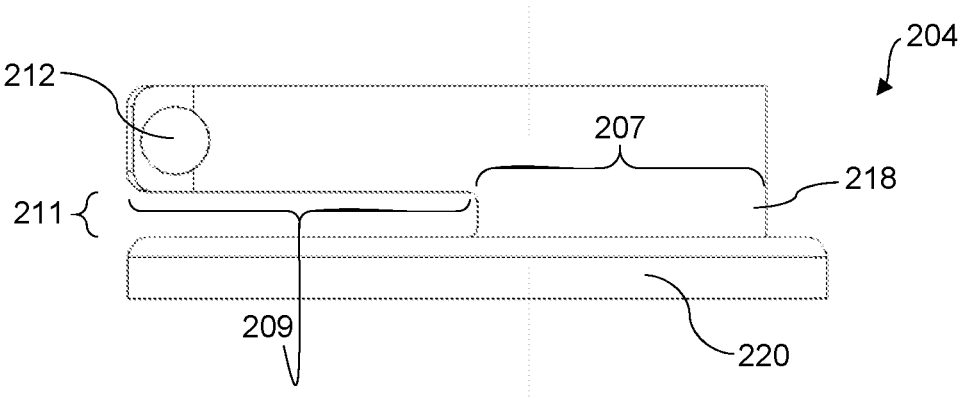
FIG. 2C is a side view of the example lock ring of FIGS. 2A and 2B.

Referring additionally to FIGS. 2B and 2C, a perspective view and a side view of the example lock ring 204 of the power plug 200 is illustrated. In some implementations, the lock ring 204 may include a collar 218 sized to fit around the connector 202 of the power plug 200, and a flange 220 disposed at a base of the collar 218. The collar 218 may axially extend, e.g., along ring longitudinal axis 205, from the flange 220 at a connected portion 207, and may be spaced from the flange 220 at a separated portion 209, e.g., by spacing 211. The collar 218 may be a substantially annular or tubular member so as to engage with the complementary cylindrical or rounded structure of the connector 202, in some implementations. The collar 218 may have another shape or geometry in other implementations, depending on the corresponding shape of the connector to which the lock ring is to be attached. Similarly, the flange 220, in some implementations, may be sized and structured to correspond with and abut against a power plug shoulder disposed adjacent to the connector to which the lock ring is to be attached.

The lock ring 204 may further include the lock tab 206 disposed on the collar 218 at the separated portion 209. The lock tab 206 may radially extend from the collar 218 and may be sized and structured to be able to insert into a lock notch of a power receptacle with which the power plug 200, or the connector 202 thereof, is to engage. In some implementations, in order to enable a clamping ability of the lock ring 204, the lock tab 206 may include a first tab portion 222*a* and a second tab portion 222*b*, spaced from the first tab portion 222*a*. The collar 218 at the separated portion 209 and the first tab portion 222*a* may define a first clamping arm 224*a*, while the collar 218 at the separated portion 209 and the second tab portion 222*b* may define a second clamping arm 224*b*. The first and second clamping arms 224*a* and 224*b* may be flexible or movable relative to one another such that when a fastener is inserted into the fastener opening 212 and tightened, the first and second clamping arms 224*a* and 224*b* may be drawn towards one another, effectively closing or reducing the space between the first and second tab portions 222*a* and 222*b* and decreasing the approximate diameter of the collar 218. Stated differently, the lock ring 204 may further include the fastener 214 to extend through the fastener opening 212 of the lock tab 206 to clamp the first clamping arm 224*a* and the second clamping arm 224*b* towards each other in order to tighten the collar 218, and thus the lock ring 204, around the outer periphery of the connector 202. Such flexibility and movement of the first and second clamping arms 224*a* and 224*b* relative to one another may be enabled by the separated portion 209 of the collar 218.

Figure 3A:
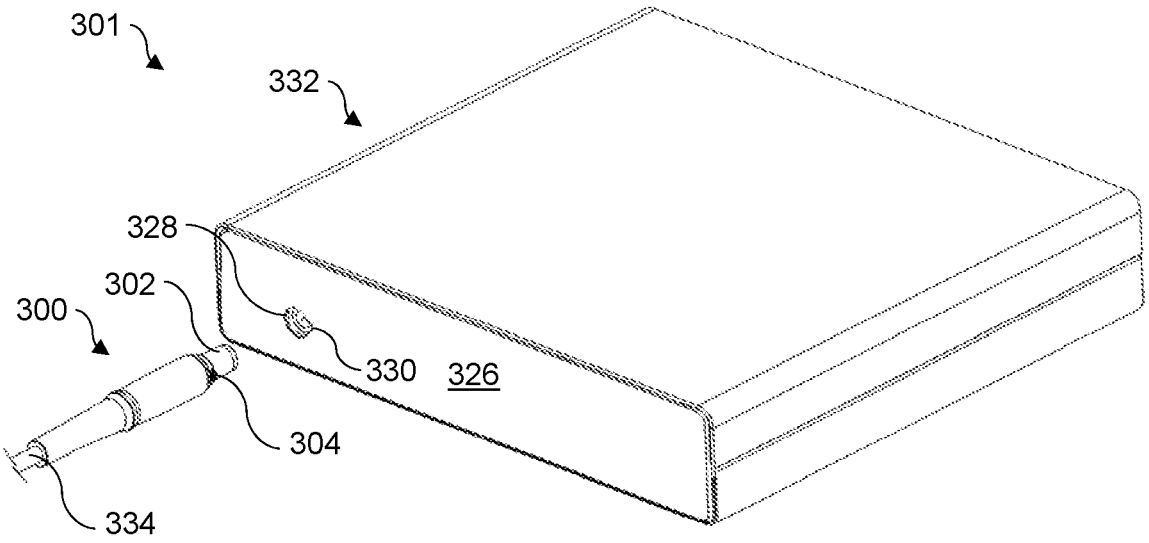
FIG. 3A is a perspective view of an example electronic device having an example power plug with a lock ring.

Referring now to FIG. 3A, a perspective view of an example electronic device 301 having an example power plug 300 with a lock ring 304 is illustrated. Example power plug 300 and lock ring 304 may be similar to example power plugs and lock rings described above. Further, the similarly-named elements of example power plug 300 and lock ring 304 may be similar in function and/or structure to the respective elements of other example power plugs and lock rings, as they are described above. Electronic device 301 may be a computing device, in some implementations. In further implementations, electronic device 301 may be a desktop PC, a mini desktop PC, a laptop computer, a tablet, a convertible PC, or any other type of computing device. In other implementations, electronic device 301 may be an imaging device such as a printer, a scanner, a copier, a multi-function imaging device, an additive manufacturing machine, or any other type of imaging device. In yet other implementations, electronic device 301 may be any device which may need or receive a power input from a power source.

Electronic device 301 may include a chassis 326. The chassis 326 may be or may be a part of an electronic device housing, casing, enclosure, frame, or other structural or aesthetic component, represented by example computing device housing 332. The chassis 326 may include a power receptacle 328. The power receptacle 328 may refer to a cutout, window, or other type of opening in the chassis 326 through which a power plug 300, or a connector 302 thereof, may insert and engage with an electronic component of the electronic device 301. In some implementations, the power receptacle 328 may refer to both the opening in the chassis 326, as well as the electronic component itself. The connector 302 may removably engage with the power receptacle 328 so as to be able to be plugged in and unplugged again. The power receptacle 328 may include a lock notch 330, in some implementations, which may be an additional cutout in the chassis 326, or a cutout or opening that is supplementary to and intersects with the power receptacle opening. In some implementations, the lock notch 330 may extend from a side of the power receptacle 328.

The electronic device 301 may further include the power plug 300, which may be attached to a power cable 334. The power cable 334 may be or may include conductive traces or lines to engage with and deliver power from a power source, through the power plug 300 and/or connector 302 thereof, to the power receptacle 328, and thus the electronic device 301. In other words, the power plug 300, or the connector 302 thereof, may provide power to the electronic device 301 through the engagement of the power plug 300, or the connector 302 thereof, with the power receptacle 328 when the power cable 334 is engaged with a power source.

In some implementations, the power cable 334 may connect the power plug 300 to a power adapter, e.g., a device to convert AC power signals to DC power signals. Thus, in some implementations, the power plug 300, power cable 334, and power adapter (not shown) may all be a part of a standalone power adapter device for use with electronic devices, and, in some implementations, may be an off-the-shelf unit that may be used or compatible with multiple different electronic devices, or electronic device types. Thus, the lock ring 304 may be able to be used with existing power plugs or power adapter devices.

As stated above, in some implementations, the power plug 300 may be another type of connector or plug, aside from a power plug. In some implementations, the power plug 300 may be a connector or plug to deliver communication signals, e.g., electrical, optical, or other communication signals. Such connectors or plugs may include coaxial connectors, audio or video signal connectors, or other types of connectors.

Figure 3B:
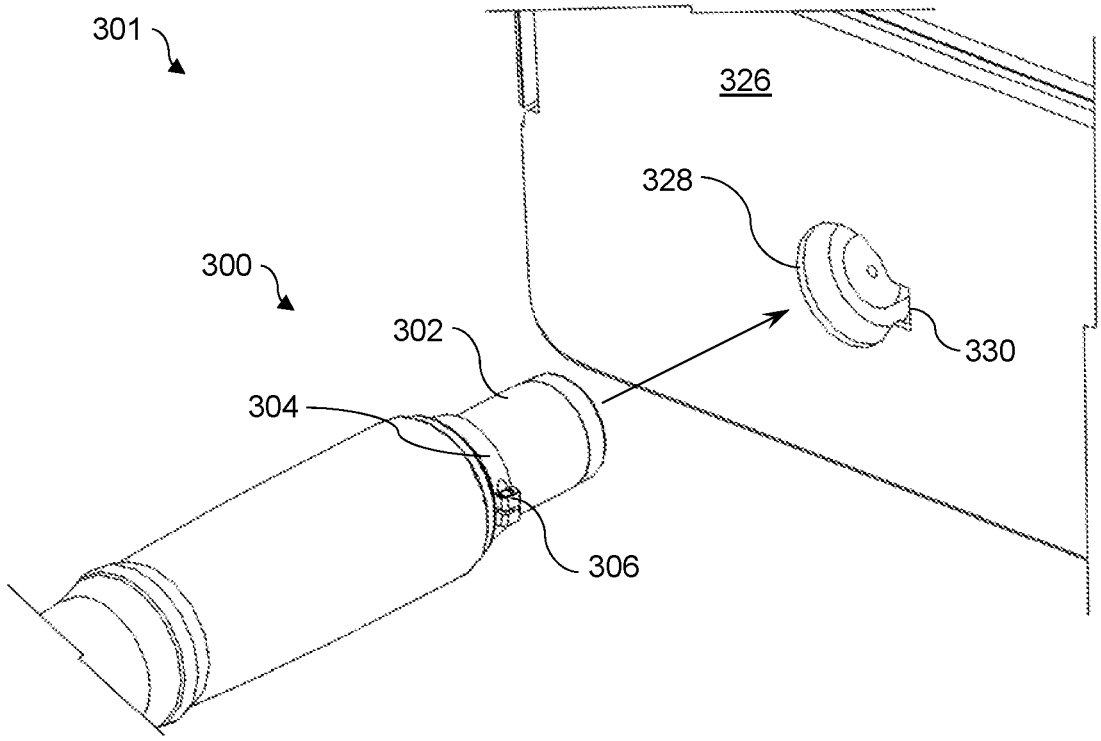
FIG. 3B is a detail perspective view of the example electronic device having an example power plug with lock ring of FIG. 3A.
Figure 3C:
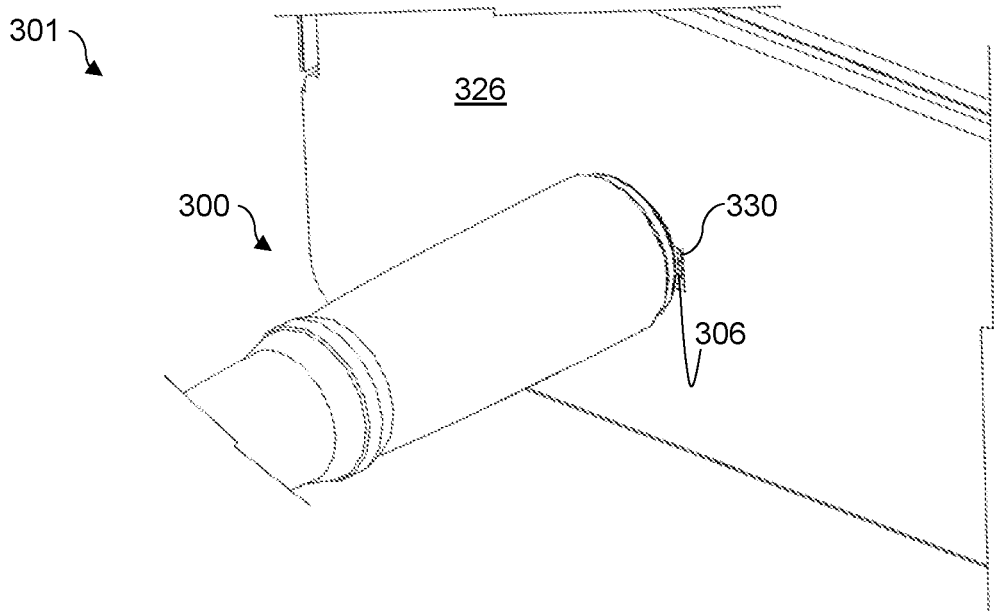
FIG. 3C is another detail perspective view of the example electronic device having an example power plug with lock ring of FIG. 3A.

Referring now to FIGS. 3B-3C, detail perspective views of the example electronic device 301 having the example power plug 300 with lock ring 304 of FIG. 3A are illustrated. FIG. 3B illustrates power plug 300 as being unplugged or disengaged with the power receptacle 328 and/or the electronic device 301, and FIG. 3C illustrates power plug 300 as being plugged in or operably engaged, i.e., mechanically and electrically engaged, with the power receptacle 328 and/or the electronic device 301. As illustrated, the lock ring 304 is installed onto the connector 302 of the power plug 300, such that the lock tab 306 is effectively fixed relative to the connector 302. Upon the power plug 300, or the connector 302 thereof, being plugged in and engaged with the power receptacle 328, the lock tab 306 may contemporaneously insert into the lock notch 330 if the lock tab 306 is aligned with the lock notch 330, as illustrated in FIGS. 3B-3C. In some situations, the lock tab 306 may be aligned with the lock notch 330 to allow complete and full operable engagement between the power plug 300, and/or connector 302, with the power receptacle 328.

Figure 3D:
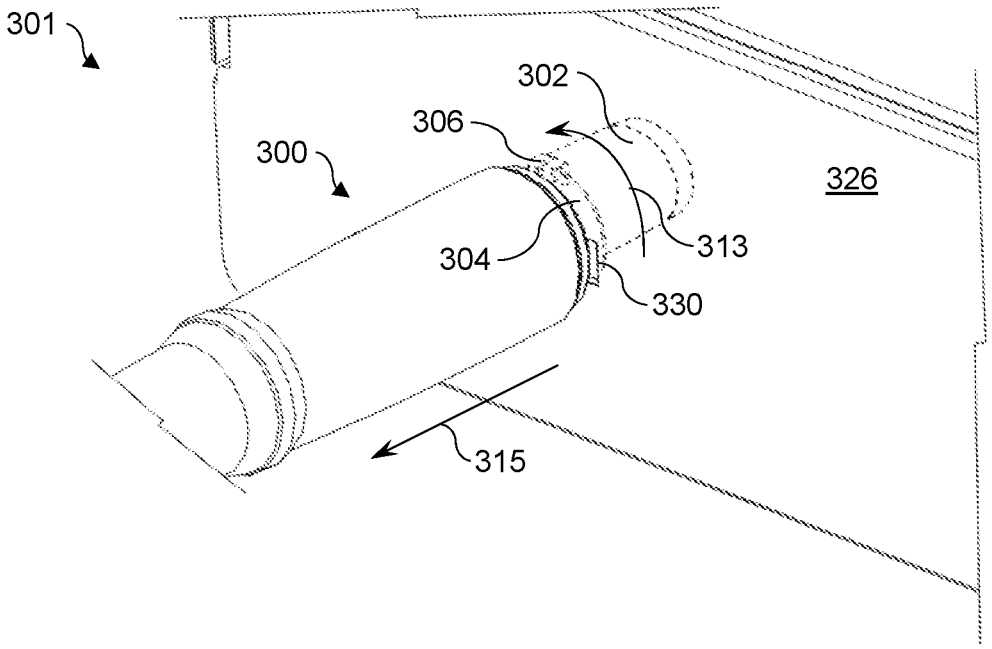
FIG. 3D is another detail perspective view of the example electronic device having an example power plug with lock ring of FIG. 3A.

Referring now to FIG. 3D, another detail perspective view of the example electronic device 301 having the example power plug 300 with lock ring 304 of FIG. 3A is illustrated, wherein the power plug 300 and/or connector 302 is operably engaged with the power receptacle 328 of the electronic device 301 such that the power plug 300, if engaged with a power source, may deliver power to the electronic device 301. Similar to FIG. 3C, the lock tab 306 has inserted into and through the lock notch 330 of the power receptacle 328. Since the connector 302 and the lock ring 304 have inserted into and through the power receptacle 328, and are now disposed within the chassis 326, they are illustrated in phantom lines.

Upon the connector 302 being engaged with the power receptacle 328, and the lock tab 306 being inserted through the lock notch 330, the power plug 300, and thus the lock ring 304, is able to rotate relative to the chassis 326, the power receptacle 328, and lock notch 330. As illustrated, e.g., by example rotation arrow 313, the power plug 300 may rotate such that the lock tab 306 is no longer aligned with the lock notch 330. Upon the lock tab 306 no longer being aligned with the lock notch 330, the power plug 300 may not be able to be unplugged, or pulled out of engagement with the power receptacle, e.g., along disengagement direction 315, without substantial and intentional force being applied. Thus, the lock tab 306 of the lock ring 304 is able to effectively lock the power plug 300 into an engaged state with the electronic device 301, thereby avoiding accidental unplugging of the power plug 300. It should be noted that, while FIG. 3D illustrates the power plug 300 and lock ring 304 as having been rotated approximately 90 degrees, any amount of rotation relative to the chassis 326 may be sufficient to misalign the lock tab 306 with the lock notch 330, and thus lock the power plug 300 in the engaged state. In order to intentionally unplug the power plug 300 from the electronic device 301, a user may rotate the power plug 300 relative to the chassis 326 until the lock tab 306 is aligned with the lock notch 330, whereupon the power plug 300 may then be pulled out and disengaged from the power receptacle 328.

What is claimed is:

1. A power plug, comprising a connector to engage with a power receptacle of an electronic device; and a removable lock ring disposed mound the connector, the lock ring comprising:

a lock tab disposed on the lock ring and extending in a direction away from a longitudinal axis of the power plug, the lock tab to insert into a lock notch of the power receptacle, wherein the lock tab comprises a fastener opening to receive a fastener, the fastener to clamp the lock ring around an outer periphery of the connector such that the lock tab is fixed relative to the connector.

2. The power plug of claim 1, wherein the connector is attached to a power cable, the power cable to engage with a power source.

3. The power plug of claim 1, wherein the lock ring is to abut against a shoulder of the power plug adjacent to the connector.

4. The power plug of claim 3, wherein the lock ring further comprises an adhesive to fix the lock ring to the shoulder of the power plug.

5. An electronic device, comprising:

a chassis having a power receptacle, the power receptacle having a lock notch;

a power plug attached to a power cable, the power cable to engage with a power source, and the power plug having a connector to removably engage with the power receptacle; and a removable lock ring disposed around the connector, the lock ring comprising:

a collar; and a lock tab disposed on the collar and extending away from the collar, the lock tab to insert into the lock notch of the power receptacle upon the connector being engaged with the power receptacle if the lock tab is aligned with the lock notch, wherein upon the connector being engaged with the power receptacle, the power plug is to rotate relative to the chassis such that the lock tab is no longer aligned with the lock notch.

6. The electronic device of claim 5, wherein the chassis is a part of a computing device housing.

7. The electronic device of claim 5, wherein the power plug is to provide power to the electronic device through the engagement of the power plug with the power receptacle when the power cable is engaged with a power source.

8. A lock ring, comprising:

a collar sized to fit around a connector of a power plug;

a flange disposed at a base of the collar, the collar to axially extend from the flange at a connected portion, and the collar axially spaced from the flange at a separated portion; and a lock tab disposed on the collar at the separated portion and radially extending from the collar, the lock tab sized to insert into a lock notch of a power receptacle.

9. The lock ring of claim 8, wherein the flange is sized to abut against a shoulder of the connector.

10. The lock ring of claim 8, further comprising an adhesive disposed on a back side of the flange.

11. The lock ring of claim 8, wherein the lock tab comprises a first tab portion and a second tab portion, spaced from the first tab portion, wherein the collar and the first tab portion define a first clamping arm, and the collar and the second tab portion define a second clamping arm.

12. The lock ring of claim 11, further comprising a fastener to extend through a fastener opening of the lock tab, the fastener to clamp the first clamping arm and the second clamping arm towards each other.

* * * * *